US008543052B2

(12) United States Patent
Herrmann

(10) Patent No.: US 8,543,052 B2
(45) Date of Patent: Sep. 24, 2013

(54) CONTROLLED VELOCITY DECOUPLING DEVICE FOR IMPROVED MEDIA REGISTRATION AT TRANSFER

(75) Inventor: Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 873 days.

(21) Appl. No.: 12/249,976

(22) Filed: Oct. 13, 2008

(65) Prior Publication Data

US 2010/0092226 A1 Apr. 15, 2010

(51) Int. Cl.
*G03G 15/00* (2006.01)

(52) U.S. Cl.
USPC ..... 399/396; 399/388

(58) Field of Classification Search
CPC ..... G03G 15/00
USPC ..... 399/388, 396
See application file for complete search history.

(56) References Cited

U.S. PATENT DOCUMENTS

| | | | | |
|---|---|---|---|---|
| 4,128,327 | A * | 12/1978 | Sugiyama et al. | 399/396 |
| 4,963,895 | A * | 10/1990 | Harada et al. | 347/232 |
| 5,428,431 | A * | 6/1995 | Abe et al. | 399/396 |
| 2006/0165452 | A1* | 7/2006 | Takiguchi et al. | 399/394 |
| 2007/0025768 | A1* | 2/2007 | Komatsu et al. | 399/167 |
| 2007/0280724 | A1* | 12/2007 | Park | 399/100 |
| 2009/0279906 | A1* | 11/2009 | Kuma et al. | 399/21 |

FOREIGN PATENT DOCUMENTS

| | | | |
|---|---|---|---|
| JP | 04062575 | A * | 2/1992 |
| JP | 09244317 | A * | 9/1997 |
| JP | 10254204 | A * | 9/1998 |
| JP | 2002362776 | A * | 12/2002 |
| JP | 2003057909 | A * | 2/2003 |
| JP | 2003149960 | A * | 5/2003 |
| JP | 2003312887 | A * | 11/2003 |
| JP | 2007219181 | A * | 8/2007 |

OTHER PUBLICATIONS

Abstract, Drawings, and Machine Translation of JP 09244317 A, JPO, Nov. 20, 2011.*
Machine Translation of JP 2002362776 A, JPO, Feb. 17, 2012.*

* cited by examiner

*Primary Examiner* — Judy Nguyen
*Assistant Examiner* — Nguyen Ha

(57) ABSTRACT

A controlled velocity decoupling device for improved media registration at transfer in a reprographic device includes a one-way clutch in a drive roll of a registration subsystem to decouple velocities between the registration subsystem and a charge retentive surface. The one-way clutched drive roll prevents the formation of a buckle in a sheet prior to the sheet engaging the charge retentive surface, and thus allowing for more controlled registration of the sheet to the charge retentive surface. The drive roll is set to a lower speed than the charge retentive surface in order to allow for variability in the velocity differences and ensure that no buckle is formed prior to transfer.

20 Claims, 3 Drawing Sheets

CONTROLLED VELOCITY DECOUPLING DEVICE FOR IMPROVED MEDIA REGISTRATION AT TRANSFER

This invention relates generally to a sheet registration device, and more particularly, to a controlled decoupling device employed in the sheet registration device that improves registration at transfer.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheet so that the developed image is placed in the proper location on the sheet. When transferring media from a registration system to a photoreceptor in a printer any velocity differential between the registration system and photoreceptor can lead to unwanted image artifacts. Image on paper (IOP) is considered critical to customer requirement. Media registration is a large component to the equation that leads to the final IOP output. Any improvement to sheet registration at the registration drive is only as valid as how that sheet registration is maintained at the transfer to the photoreceptor. Essentially, once the lead edge of the sheet has left the registration drive nip the paper is being "pushed" to the photoreceptor. Each sheet reacts differently to being pushed based on its beam strength, environmental conditions, and other paper properties, such as, curl and grain direction. The impact on registration due to these effects is known by those skilled in the art. It is also known that tighter baffle spacing is important in maintaining registration accuracy of the lead edge as it is pushed to the photoreceptor.

On the other side of the IOP equation is the transfer of the image to the sheet occurring at that photoreceptor. Any mismatch in the drive velocities between the photoreceptor and the registration drive nip will have a negative impact on the IOP and will result in media handling related image artifacts.

Various schemes have been developed to overcome this problem of velocity mismatch, for example, as shown in U.S. Pat. No. 5,428,431 a buckle is built ahead of the photoreceptor and then removed during transfer. Also, printers such as shown in Prior Art FIG. 1 decouple the velocity by increasing the size of the pre-transfer baffle gap between baffles 16 and 17 to allow for a "decoupling buckle" to form in the sheet 18. This allows for some mismatch in velocities of a registration nip formed between idler roll 14 and drive roll 15 and the photoreceptor 10 which is entrained around drive roll 11 and idler roll 12. An idler roll 13 is used to maintain frictional contact between sheet 18 and photoreceptor 10. A larger transfer baffle gap allows for the formation of buckles and can lead to lead edge stubbing with curled sheets. Both characteristics degrade registration performance. In addition, this buckling effect to allow for decoupling has the opposite effect on registration performance. Because the sheet is flexible, there is significant impact to the lead edge arrival of the sheet at transfer.

Hence, there is still a need for a device that improves media registration at transfer.

Accordingly, a velocity decoupling device is disclosed that includes a one-way clutch in a drive roll of a registration subsystem to decouple velocities between the registration subsystem and a photoreceptor. The one-way clutched drive roll prevents the formation of a buckle in a sheet prior to the sheet engaging the photoreceptor and thus allowing for more controlled registration of the sheet to the photoreceptor. The drive roll is set to a lower speed than the photoreceptor in order to allow for variability in the velocity differences and ensure that no buckle is formed prior to transfer.

The disclosed reprographic system that incorporates the disclosed improved device that improves media registration at transfer may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
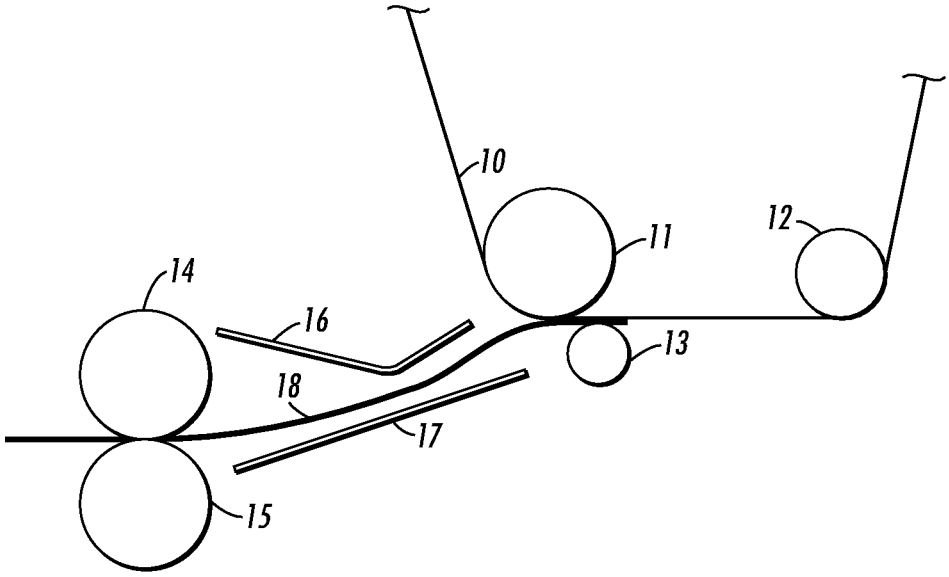
FIG. 1 (PRIOR ART)
FIG. 1 is an enlarged, partial frontal view of prior art registration and photoreceptor subsystems for registering sheets with a photoreceptor.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for decoupling velocities between registration and a photoreceptor.

For a general understanding of the features of the disclosure, reference is made to the drawings. In the drawings, like reference numerals have been used throughout to identify identical elements.

Figure 2:
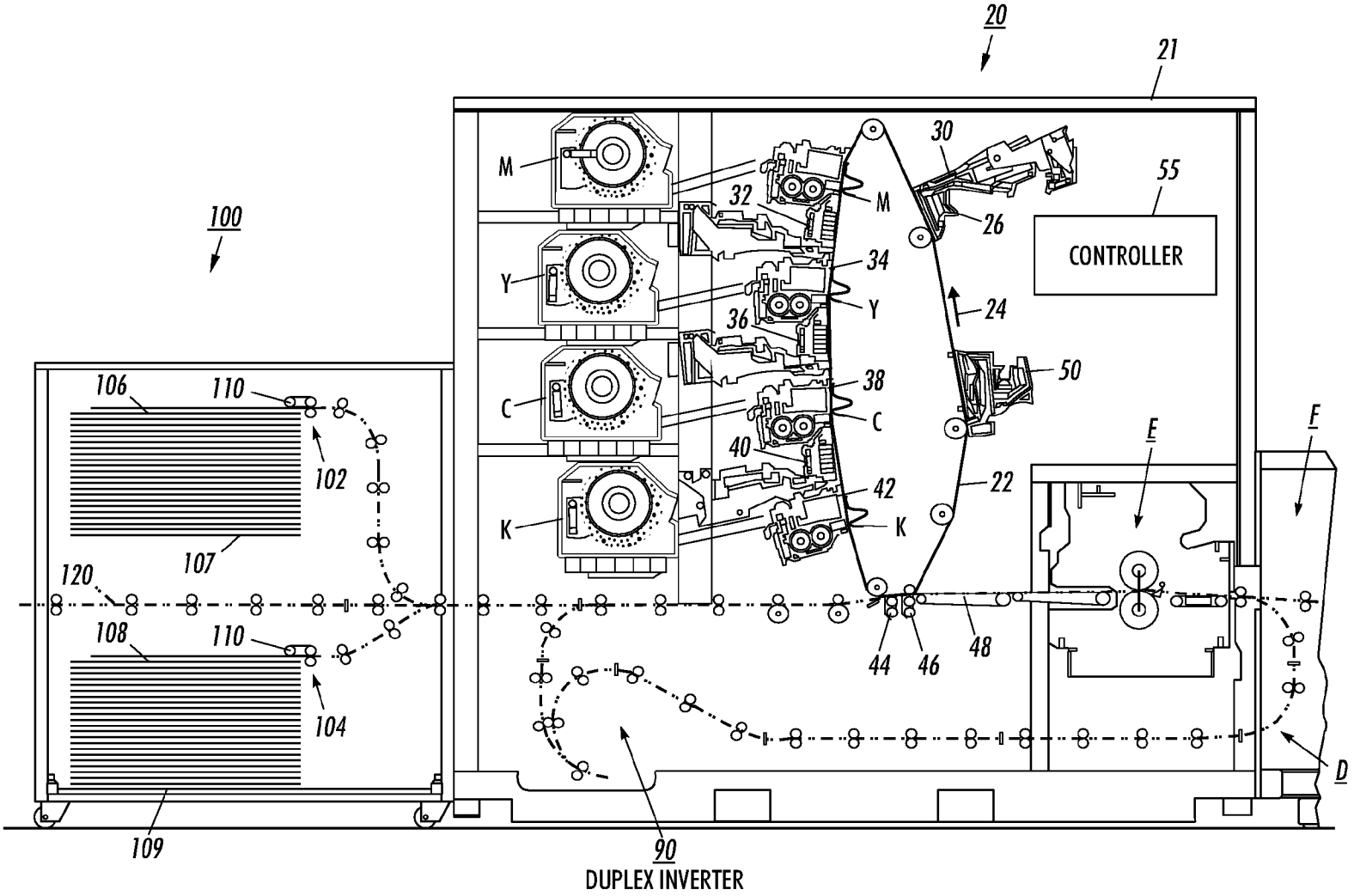
FIG. 2 is a partial, frontal view of an exemplary modular xerographic printer that includes a registration subsystem in accordance with the present disclosure for registering sheets with a photoreceptor.

Referring now to printer 20 in FIG. 2, as in other xerographic machines, and as is well known, an electrographic printing system is shown including the controlled velocity decoupling device of the present disclosure for improved media registration at transfer. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Marking module 21 includes a charge retentive substrate which could be a photoreceptor belt 22 that advances in the direction of arrow 24 through the various processing stations around the path of belt 22. Charger 26 charges an area of belt 22 to a relatively high, substantially uniform potential. Next, the charged area of belt 22 passes laser 30 to expose selected areas of belt 22 to a pattern of light, to discharge selected areas to produce an electrostatic latent image. Next, the illuminated area of the belt passes developer unit M, which deposits magenta toner on charged areas of the belt.

Subsequently, charger 32 charges the area of belt 22 to a relatively high, substantially uniform potential. Next, the charged area of belt 22 passes laser 34 to expose selected areas of belt 22 to a pattern of light, to discharge selected areas to produce an electrostatic latent image. Next, the illuminated area of the belt passes developer unit Y, which deposits yellow toner on charged areas of the belt.

Subsequently, charger 36 charges the area of belt 22 to a relatively high, substantially uniform potential. Next, the charged area of belt 22 passes laser 38 to expose selected areas of belt 22 to a pattern of light, to discharge selected areas to produce an electrostatic latent image. Next, the illuminated area of the belt passes developer unit C, which deposits cyan toner on charged areas of the belt.

Subsequently, charger 40 charges the area of belt 22 to a relatively high, substantially uniform potential. Next, the charged area of belt 22 passes laser 42 to expose selected areas of belt 22 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 22. In synchronism with the movement of the image on belt 22, a registration system 60 that is more particularly disclosed and described herein with reference to FIG. 3, receives copy sheets from sheet feeder module 100 and brings the copy sheets into contact with the image on belt 22. Sheet feeder module 100 includes high capacity feeders 102 and 104 that feed sheets from sheet stacks 106 and 108 positioned on media supply trays 107 and 109 and directs them along sheet path 120 to imaging or marking module 21 without forming a buckle in the sheets prior to and after the driver roll 62 and idler roll 63 nip of FIG. 3. Additional high capacity media trays or sheet inserter trays could be added to feed sheets along sheet path 120, if desired.

A corotron 44 charges a sheet to tack the sheet to belt 22 and to move the toner from belt 22 to the sheet. Subsequently, detack corotron 46 charges the sheet to an opposite polarity to detack the sheet from belt 22. Prefuser transport 48 moves the sheet to fuser E, which permanently affixes the toner to the sheet with heat and pressure. The sheet then advances to conventional stacker module F, or to duplex loop D.

Cleaner 50 removes toner that may remain on the image area of belt 22. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 3:
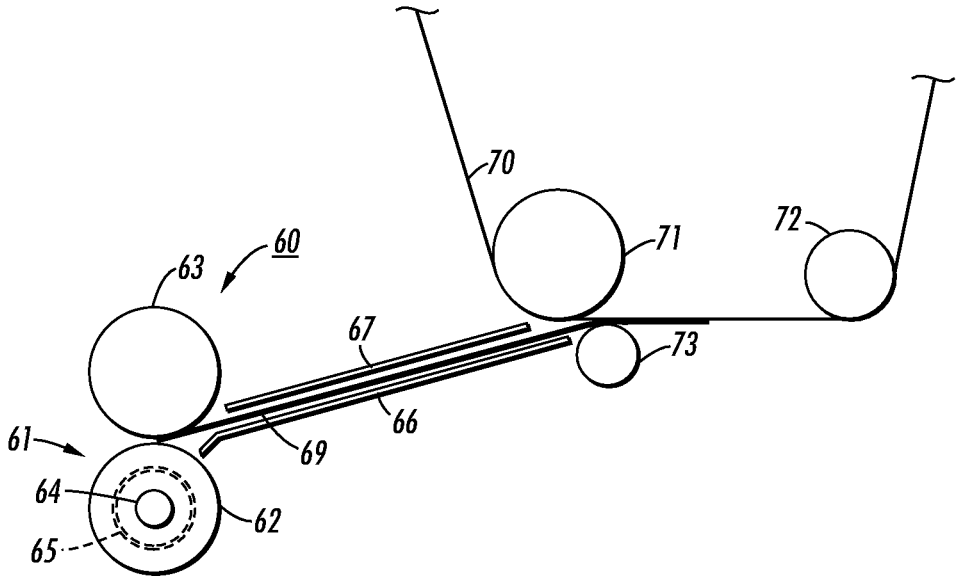
FIG. 3 is partial and enlarged frontal view of the registration subsystem shown in FIG. 2.

With reference to FIG. 3 and in accordance with the present disclosure, a velocity decoupling device 61 is shown as a part of the registration nip drive/idler assembly 60 that maintains control of a sheet being registered. The decoupling device 61 includes a conventional one-way clutch 65 (for example, a drawn cup roller clutch sold by The TIMKIN Company, Canton, Ohio) that is installed within drive roll 62 with the drive roll in turn installed over a conventional drive shaft 64. An idler roll 63 forms a sheet drive nip with drive roll 62 and drives sheets 69 between lower baffle 66 and upper baffle 67 that maintains each sheet in constraining, non-buckling fashion en route to a transfer hand-off point with photoreceptor 70. Photoreceptor 70 is tensioned and driven by drive roll 71 and idler roll 72 with sheet 69 being held in driving relation against photoreceptor 70 by idler roll 73. As a result, decoupling is provided that enhances and improves transfer while maintaining control of the sheet right up to transfer. By including the decoupling function in the drive itself a smaller more optimum pre-transfer baffle gap can be used to control the registration performance without the simultaneous need for the baffle to decouple the velocities. This application of a one-way clutch allows for the needed precision in the registration drive units and balances that precision with the added function of allowing for the decoupling of any velocity mismatch at transfer. For example, the registration drive system can be driven at a predetermined percent (~2%-4%) lower velocity than transfer. As tacking occurs, the sheet is no longer in the control of the registration nip drive since the one way clutch allows for the sheet to be "pulled" by the transfer system. The velocity decoupling eliminates artifacts associated with any velocity mismatch while allowing the two systems to maintain control over the sheet during the had-off from registration to transfer.

In operation, with the one-way clutch being installed in the drive roll that is installed on a rotatable drive shaft, the drive shaft rotates in a clockwise direction. As the drive shaft turns, in a conventional manner the one-way clutch locks to the drive shaft to create drive to the drive roll. When a sheet is driven by the registration drive roll/idler roll nip it is pulled at a higher velocity by a downstream "nip" (i.e., tacking on the photoreceptor belt). The registration drive roll is free to rotate faster than the registration drive shaft is turning. The one-way clutch allows for free clockwise movement at any velocity above the angular velocity of the drive shaft. In addition, the one-way clutch can have frictional loading to maintain a predetermined level of tension in the sheet.

It should now be understood that an improvement has been disclosed that provides controlled velocity decoupling for hand-off between a registration drive nip and a photoreceptor (or any downstream nip) that limits velocity/force differential effects while maintaining accurate sheet control by the use of a one-way clutch in a shaft mounted drive roll. Several advantages are obtained with the use of the one-way clutch mounted within a drive roll including the elimination of the need to have a pre-transfer baffle that allows for sheet buckle as a velocity decoupler. This reduces the sheet dynamics, such as, trail edge flip and process velocity errors, which lead to image artifacts. It also eliminates the need to closely match velocities to eliminate hand-off issues. In addition, the device is easily incorporated into current registration/transfer design and the one-way technology is proven in media handling applications. Further, balanced resistance is provided to control tension between upstream and downstream drives.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device that provides controlled velocity decoupling for copy sheet hand-off between a registration drive nip and a photoreceptor, comprising:

a controller that receives an image signal representing an image to be printed;

a single charge retentive surface;

a charging station that charges the charge retentive surface to a relatively high potential;

an exposure station that receives images signals from the controller and records an electrostatic latent image on said charge retentive surface;

a development station that deposits toner over the electrostatic latent image on said charge retentive surface to form a toner image;

a single transfer station including a single transfer member that transfers the toner image directly from said charge retentive surface to a copy sheet; and a registration system for registering copy sheets with said charge retentive surface without forming a buckle within the copy sheets in close proximity to a non-intermittently driven driver roll and idler roll nip of said registration system prior to reaching said charge retentive surface, said registration system including a decoupling device configured to eliminate artifacts associated with any velocity mismatch while simultaneously allowing control to be maintained over said copy sheets during the hand-off from said registration system while tacking directly to said charge retentive surface prior to reaching said transfer station without using a buckle sensor in close proximity to said decoupling device, said decoupling device including a one-way clutch mounted with respect to said driver roll such that it allows said driver roll to rotate freely at an increased speed while said copy sheets are being pulled solely by said charge retentive surface once they are tacked to said charge retentive surface.

2. The reprographic device of claim 1, wherein said charge retentive surface is a photoreceptor.

3. The reprographic device of claim 2, wherein said photoreceptor is a belt.

4. The reprographic device of claim 3, wherein said one-way clutch is mounted within said driver roll, and wherein said copy sheets are driven into said non-intermittently driven driver roll and idler roll nip without forming a buckle within said copy sheets.

5. The reprographic device of claim 4, including upper and lower baffles that are adapted to maintain a constraining, non-buckling profile of said copy sheets en route to a transfer hand-off point with said charge retentive surface.

6. The reprographic device of claim 5, wherein said one-way clutch includes frictional loading to maintain a predetermined level of tension in the sheets.

7. The reprographic device of claim 5, wherein said baffles are parallel to each other.

8. The reprographic device of claim 6, wherein said baffles have a flat profile and are configured to prevent a buckle from being formed in copy sheets passing therethrough.

9. The reprographic device of claim 8, wherein copy sheets driven by said driver roll are pulled at a higher velocity by a downstream nip formed between said copy sheets and said charge retentive surface.

10. The reprographic device of claim 9, wherein said one-way clutch facilitates said pulling of said copy sheets by said charge retentive surface.

11. A method for decoupling sheets from a registration drive system that enhances and improves transfer while maintaining control of a sheet right up to transfer in a printer, comprising:

providing a controller that receives an image signal representing an image to be printed;

providing a single charge retentive surface;

providing a charging station that charges the charge retentive surface to a relatively high potential;

providing an exposure station that receives images signals from the controller and records an electrostatic latent image on said charge retentive surface;

providing a development station that deposits toner over the electrostatic latent image on the charge retentive surface to form a toner image;

providing a single transfer station including a single transfer member that transfers the toner image directly from said charge retentive surface to said sheets; and providing a registration system for registering sheets with said charge retentive surface before reaching said transfer station, said registration system including a driver roll and an idler roll forming a nip for driving sheets therethrough and a decoupling device that provides controlled velocity decoupling for hand-off of said sheets between said nip and said charge retentive surface for direct hand-off of said sheets to said charge retentive surface without forming an artifact inducing buckle in said sheets prior to and after said driver roll and idler roll nip and without using a buckle sensor in close proximity to said decoupling device, said decoupling device including a one-way clutch mounted with respect to said driver roll such that it allows said driver roll to rotate freely at an increased speed while the sheets are being pulled by said charge retentive surface once they are tacked directly to said charge retentive surface prior to reaching said transfer station to thereby increase control of a lead edge of each sheet being tacked to said charge retentive surface with said driver roll and said idler roll continuing to roll while each sheet is tacked to said charge retentive surface.

12. The method of claim 11, including providing said charge retentive surface as a photoreceptor.

13. The method of claim 12, including positioning said photoreceptor as a belt.

14. The method of claim 13, including mounting said one-way clutch within said driver roll.

15. The method of claim 14, including providing upper and lower baffles that are adapted to maintain a constraining, non-buckling profile of said sheets en route to a transfer hand-off point with said charge retentive surface.

16. The method of claim 15, wherein said one-way clutch includes frictional loading to maintain a predetermined level of tension in said sheets.

17. The method of claim 15, wherein said baffles are parallel to each other.

18. The method of claim 16, wherein said baffles have a flat profile and are configured to prevent a buckle from being formed in sheets passing therethrough.

19. The method of claim 18, including driving said sheets by said driver roll at a first velocity and pulling said sheets at a second and higher velocity by a downstream nip formed between said sheets and said charge retentive surface.

20. A printer that provides controlled velocity decoupling for copy sheet hand-off between a registration drive nip and a photoreceptor, comprising:

a controller that receives an image signal representing an image to be printed;

a single charge retentive surface;

a charging station that charges the charge retentive surface to a relatively high potential;

an exposure station that receives images signals from the controller and records an electrostatic latent image on said charge retentive surface;

a development station that deposits toner over the electrostatic latent image on said charge retentive surface to form a toner image;

a single transfer station including a single transfer member that transfers the toner image directly from said charge retentive surface to a copy sheet; and a registration system for registering copy sheets with said charge retentive surface, said registration system including a driver roll and an idler roll forming a nip for driving sheets therethrough without buckling said copy sheets at said nip and a decoupling device configured to eliminate artifacts associated with any velocity mismatch while simultaneously allowing control to be maintained over said copy sheets during the hand-off from said registration system to said charge retentive surface, said decoupling device including a one-way clutch mounted with respect to said driver roll such that it allows said driver roll to rotate freely at an increased speed while said copy sheets are being pulled solely by said charge retentive surface once they are tacked to said charge retentive surface.

* * * * *